US011183122B2

(12) United States Patent
Yang et al.

(10) Patent No.: US 11,183,122 B2
(45) Date of Patent: Nov. 23, 2021

(54) DISPLAY DEVICE WITH DEMULTIPLEXER FOR CONNECTING OUTPUT LINE OF DATA DRIVER TO ONE OF MULTIPLE SUB-DATA LINES

(71) Applicant: SAMSUNG DISPLAY CO., LTD., Yongin-si (KR)

(72) Inventors: Jin Wook Yang, Yongin-si (KR); Soon Dong Kim, Yongin-si (KR); Chang Noh Yoon, Yongin-si (KR); Eun Gyeong Choe, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 91 days.

(21) Appl. No.: 16/539,044

(22) Filed: Aug. 13, 2019

(65) Prior Publication Data

US 2020/0111420 A1 Apr. 9, 2020

(30) Foreign Application Priority Data

Oct. 5, 2018 (KR) ..... 10-2018-0119231

(51) Int. Cl.
*G09G 3/3266* (2016.01)
*G09G 3/3258* (2016.01)
(Continued)

(52) U.S. Cl.
CPC ..... *G09G 3/3266* (2013.01); *G09G 3/3233* (2013.01); *G09G 3/3258* (2013.01); *G09G 3/3275* (2013.01)

(58) Field of Classification Search
CPC .. G09G 3/3291; G09G 3/3275; G09G 3/3258; G09G 3/3233; G09G 3/3266; G09G 2340/0435; G09G 2310/0297; G09G 2320/045; G09G 2300/0842; G09G 2300/0819; G09G 2300/0861; G09G 3/20; G09G 2300/0804
See application file for complete search history.

(56) References Cited

U.S. PATENT DOCUMENTS 10,325,558 B2 6/2019 Choe et al.
2012/0229438 A1* 9/2012 Fujita ..... G09G 3/3283 345/211

(Continued)

FOREIGN PATENT DOCUMENTS

KR 10-2019-0014298 2/2019
KR 10-2019-0015664 2/2019

OTHER PUBLICATIONS

Sang Soo Kim et al., "World's First 240Hz TFT-LCD Technology for Full-HD LCD-TV and Its Application to 3D Display", SID 09 Digest, pp. 424-427.

*Primary Examiner* — Roberto W Flores
(74) *Attorney, Agent, or Firm* — F. Chau & Associates, LLC

(57) ABSTRACT

A display device includes pixels sequentially arranged along a first direction, a data driver having output lines and generating data signals, data lines each including sub-data lines extended along the first direction, demultiplexers each connecting a corresponding output line of the output lines to a corresponding data line of the data lines and switching the corresponding output line to one of the sub-data lines one at a time so that each of the data signals is supplied to a corresponding pixel of the pixels.

19 Claims, 13 Drawing Sheets

(51) Int. Cl.
*G09G 3/3233* (2016.01)
*G09G 3/3275* (2016.01)

(56) References Cited

U.S. PATENT DOCUMENTS

| | | | | |
|---|---|---|---|---|
| 2014/0353616 | A1* | 12/2014 | Park | G09G 3/3233 257/40 |
| 2015/0287378 | A1* | 10/2015 | Jeong | G09G 3/2085 345/694 |
| 2017/0033173 | A1* | 2/2017 | Kim | G09G 3/3225 |
| 2017/0221979 | A1* | 8/2017 | Chae | H01L 27/3262 |
| 2018/0182336 | A1* | 6/2018 | Xing | G09G 3/3688 |
| 2018/0240421 | A1* | 8/2018 | Yamazaki | H01L 29/7869 |
| 2019/0043421 | A1 | 2/2019 | Yang et al. | |
| 2019/0219879 | A1* | 7/2019 | Imai | G09G 3/3648 |
| 2021/0210035 | A1* | 7/2021 | Yamazaki | H01L 27/1262 |

* cited by examiner

DISPLAY DEVICE WITH DEMULTIPLEXER FOR CONNECTING OUTPUT LINE OF DATA DRIVER TO ONE OF MULTIPLE SUB-DATA LINES

CROSS-REFERENCE TO RELATED APPLICATION

The present application claims priority under 35 U.S.C. § 119(a) to Korean patent application 10-2018-0119231 filed on Oct. 5, 2018 in the Korean Intellectual Property Office, the entire disclosure of which is incorporated by reference herein.

BACKGROUND

1. Technical Field

The present disclosure generally relates to a display device; more particularly, a display device having a plurality of sub-data lines time divisionally connected to an output line of a data driver.

2. Related Art

Recently, various display devices have been developed. The display devices include a liquid crystal display device, a plasma display device, an organic light emitting display device, and the like.

Display devices include a display panel and a driver for driving the display panel. The display panel includes pixels connected to scan lines and data lines, the pixels being arranged in a matrix form. Each of the pixels is supplied with a data voltage of a data line in response to a scan signal of a scan line, and expresses a grayscale according to the supplied data voltage, thereby displaying an image.

SUMMARY

According to an exemplary embodiment of the present inventive concept, a display device includes pixels, a data driver supplying data signals to an output line, a data line including a first sub-data line, a second sub-data line, a third sub-data line, and a fourth sub-data line, and a demultiplexer. The demultiplexer switches the output line to one of the first, second, third and fourth sub-data lines one at a time so that each data signal is supplied to a corresponding pixel. Each sub-data line is extended along a first direction and the sub-data lines are arranged in a second direction crossing the first direction. The pixels include a first pixel, a second pixel, a third pixel, and a fourth pixel, which are sequentially arranged along the first direction. The first sub-data line is connected to the first pixel, the second sub-data line is connected to the third pixel, the third sub-data line is connected to the fourth pixel, and the fourth sub-data line is connected to the second pixel.

According to an exemplary embodiment of the present inventive concept, a display device includes pixels sequentially arranged along a first direction, a data driver having output lines and generating data signals, data lines each including sub-data lines extended along the first direction, demultiplexers each connecting a corresponding output line of the output lines to a corresponding data line of the data lines and switching the corresponding output line to one of the sub-data lines one at a time so that each of the data signals is supplied to a corresponding pixel of the pixels.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
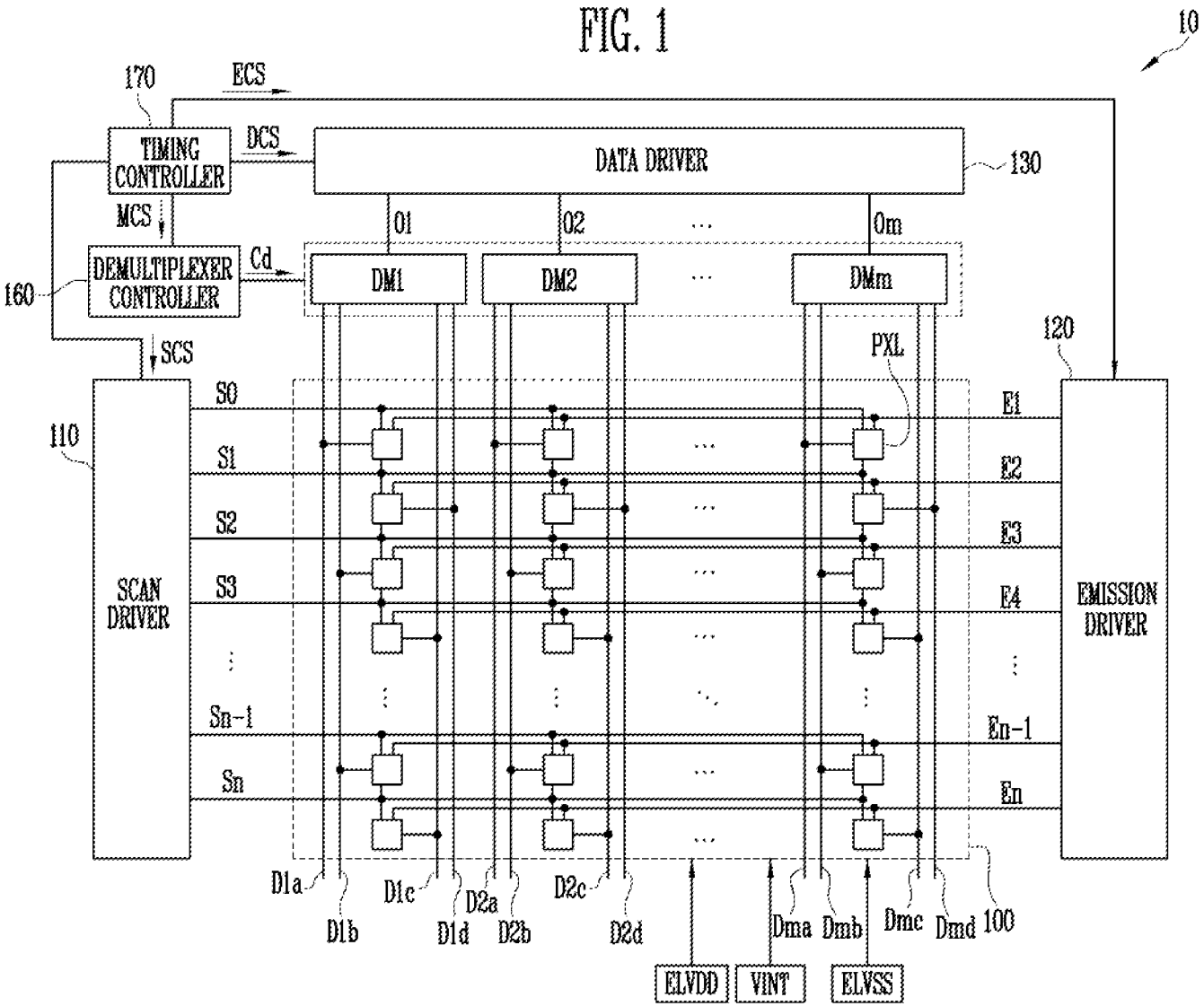
FIG. 1 is a diagram illustrating a configuration of a display device according to an embodiment of the present disclosure.

The advantages and features of the present invention, and the way of attaining them, will become apparent with reference to embodiments described below in conjunction with the accompanying drawings. However, the present disclosure is not limited to the embodiments but may be implemented into different forms. These embodiments are provided only for illustrative purposes and for full understanding of the scope of the present disclosure by those skilled in the art. In the entire specification, when an element is referred to as being "connected" or "coupled" to another element, it can be directly connected or coupled to the another element or be indirectly connected or coupled to the another element with one or more intervening elements interposed therebetween. It should note that in giving reference numerals to elements of each drawing, like reference numerals refer to like elements even though like elements are shown in different drawings.

Hereinafter, a display device will be described with reference to exemplary embodiments in conjunction with the accompanying drawings.

FIG. 1 is a diagram illustrating a configuration of a display device according to an embodiment of the present disclosure.

Referring to FIG. 1, the display device 10 according to the embodiment of the present disclosure may include pixels PXL, a scan driver 110, an emission driver 120, a data driver 130, demultiplexers DM1 to DMm, a demultiplexer controller 160, and a timing controller 170.

The pixels PXL may be connected to a plurality of scan lines S0 to Sn, a plurality of emission lines E1 to En, and sub-data lines D1*a* to Dmd. The sub-data lines D1*a* to Dmd may be grouped into data lines D1 to Dm according to their connection to the demultiplexers DM1 to DMm. For example, four sub-data lines D1*a*, D1*b*, D1*c* and D1*d* are connected to a demultiplexer DM1 and are grouped as a first data line D1. Accordingly, the pixels PXL may be supplied with scan signals and emission control signals respectively through the scan lines S0 to Sn and the emission lines E1 to En. Also, the pixels PXL may be supplied with data signals through the sub-data lines D1*a* to Dmd.

The pixels PXL may be connected to a first power source ELVDD, a second power source ELVSS, and an initialization power source VINT, to receive power voltages provided from the first power source ELVDD, the second power source ELVSS, and the initialization power source VINT.

Each of the pixels PXL may control an amount of current flowing from the first power source ELVDD to the second power source ELVSS via a light emitting diode (not shown), corresponding to a data signal. The light emitting diode may generate light with a luminance corresponding to the amount of current.

The scan driver 110 may supply scan signals to the scan lines S0 to Sn, corresponding to a scan driving control signal SCS from the timing controller 170. For example, the scan driver 110 may sequentially supply the scan signals to the scan lines S0 to Sn. When the scan signals are sequentially supplied to the scan lines S0 to Sn, the pixels PXL may be sequentially selected in units of horizontal lines. The scan signal may have a first voltage level at which a transistor supplied with the scan signal is turned on. A time duration during which the scan signal has the first voltage level is called a turn-on period. For example, during the turn-on period of the scan signal, the transistor supplied therewith remains turned on. Other than the turn-on period, the scan signal has a second voltage level at which the transistor remains turned off. The turn-on period of the scan signal may be periodically repeated in the scan signal. When the transistor is a P-type metal-oxide-semiconductor (PMOS) transistor, the first voltage level is a low level and the second voltage level is a high level. When the transistor is an N-type metal-oxide-semiconductor (NMOS) transistor, the first voltage level is a high level and the second voltage level is a low level.

The emission driver 120 may supply emission control signals to the emission lines E1 to En, corresponding to an emission driving control signal ECS from the timing controller 170. For example, the emission driver 120 may sequentially supply the emission control signals to the emission lines E1 to En. The emission control signal may have a first voltage level at which a transistor supplied therewith is turned on and a second voltage level at which the transistor supplied therewith is turned off.

The data driver 130 may supply data signals to output lines O1 to Om, corresponding to a data driving control signal DCS. That is, the data driver 130 may supply the data signals to the demultiplexers DM1 to DMm through the output lines O1 to Om.

The demultiplexers DM1 to DMm may be supplied with data signals from the data driver 130, and supply the data signals to the sub-data lines D1*a* to Dmd. For example, the demultiplexers DM1 to DMm may receive data signals transmitted through the output lines O1 to Om, and time-divisionally output the data signals to the sub-data lines D1*a* to Dmd of which number is larger than that of the output lines O1 to Om. Therefore, the pixels PXL may be supplied with the data signals through the sub-data lines D1*a* to Dmd. For example, the number of the sub-data lines D1*a* to Dmd may be set to be four times that of the output lines O1 to Om of the data driver 130. The present inventive concept is not limited thereto. For example, the number of the sub-data lines D1*a* to Dmd may be set to be more than or less than four times that of the output lines O1 to Om of the data driver 130.

Although not separately shown, capacitors (not shown) may exist in the respective sub-data lines D1*a* to Dmd to store signals applied to the sub-data lines D1*a* to Dmd. The capacitors existing in the sub-data lines D1*a* to Dmd may be implemented by parasitic capacitance. Also, the capacitors may be physically installed in the sub-data lines D1*a* to Dmd.

The demultiplexer controller 160 may control operations of the demultiplexers DM1 to DMm through a driving signal Cd. For example, the driving signal Cd may function to control operations of transistors included in each of the demultiplexers DM1 to DMm. The demultiplexer controller 160 may receive a demultiplexer control signal MCS supplied from the timing controller 170, and generate a driving signal Cd in response to the demultiplexer control signal MCS.

Although a case where the demultiplexer controller 160 is provided separately from the timing controller 170 is illustrated in FIG. 1, the demultiplexer controller 160 may be integrated with the timing controller 170.

The timing controller 170 may control the scan driver 110, the emission driver 120, the data driver 130, and the demultiplexer controller 160. To this end, the timing controller 170 may supply the scan driving control signal SCS and the emission driving control signal ECS respectively to the scan driver 110 and the emission driver 120.

Also, the timing controller 170 may supply the data driving control signal DCS and the demultiplexer control signal MCS respectively to the data driver 130 and the demultiplexer controller 160.

For convenience of description, a case where the scan driver 110, the emission driver 120, the data driver 130, the demultiplexer controller 160, and the timing controller 170 are provided separately from each other is illustrated in FIG. 1. However, at least some of the components may be integrated.

The first power source ELVDD, the second power source ELVSS, and the initialization power source VINT may provide power voltages to the pixels PXL located in a pixel array 100. For example, the first power source ELVDD may be a high potential power source, and the second power source ELVSS may be a low potential power source. In an example, the first power source ELVDD may be set to a positive voltage, and the second power source ELVSS may be set to a negative voltage or ground voltage. In addition, the initialization power source VINT may be set to a voltage lower than the data signal.

Figure 2:
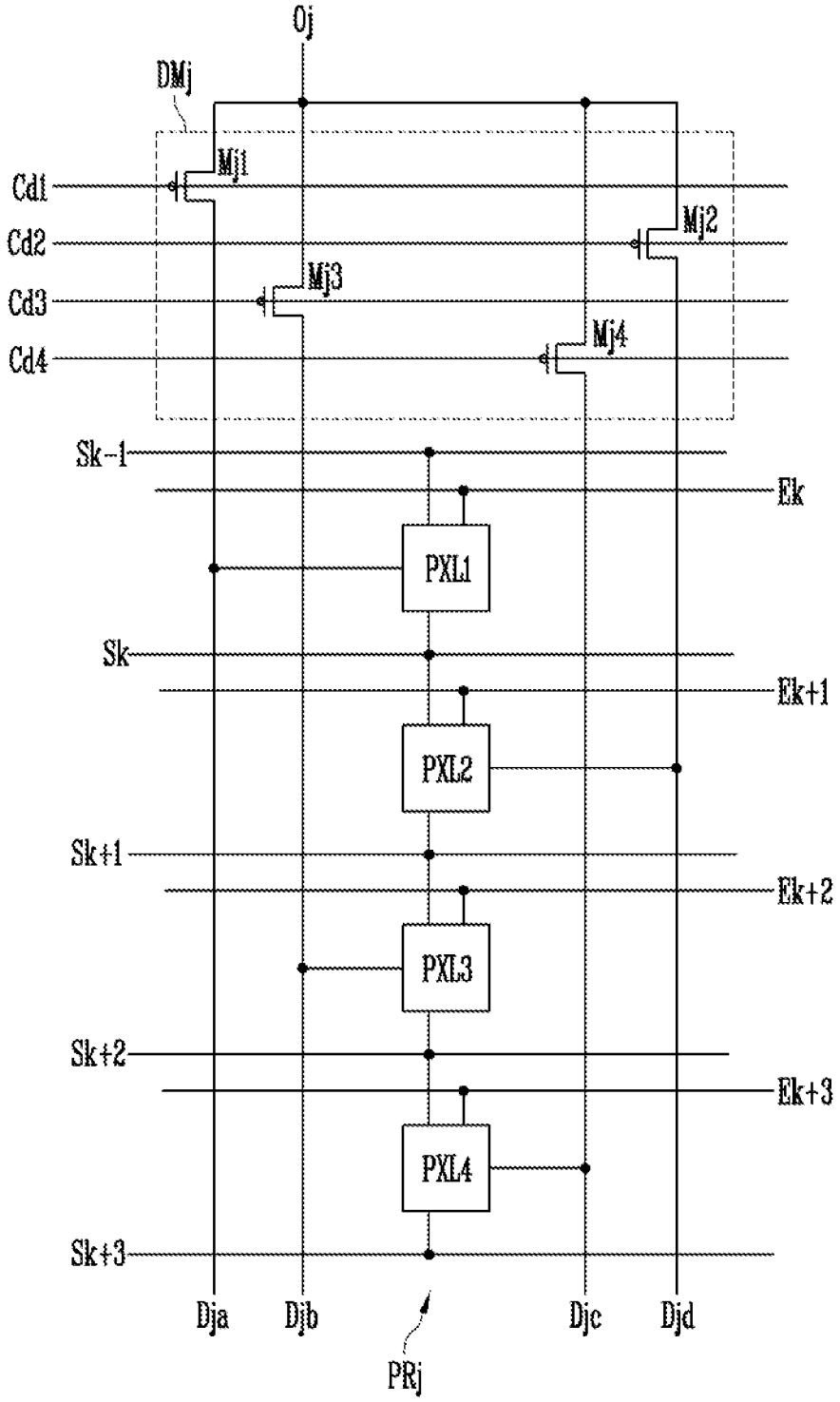
FIG. 2 is a diagram illustrating a configuration of a demultiplexer according to an embodiment of the present disclosure.

FIG. 2 is a diagram illustrating a configuration of a demultiplexer according to an embodiment of the present disclosure. For convenience of description, a jth (j is a natural number) demultiplexer DMj connected to a jth output line Oj that transmits a data signal generated from the data driver 130 of FIG. 1 and a jth pixel column PRj are illustrated in FIG. 2.

Referring to FIGS. 1 and 2, the jth demultiplexer DMj may be connected to the jth output line Oj and jth data line Dj having four sub-data lines Dja, Djb, Djc, and Djd. The jth data line Dj may include a first sub-data line Dja, a second sub-data line Djb, a third sub-data line Djc, and a fourth sub-data line Djd. For example, each data line may be time-divisionally connected to one of the four sub-data lines using a demultiplexer. The present inventive concept is not limited thereto. For example, each data line may be time-divisionally connected to one of more than or less than four sub-data lines using a demultiplexer.

The jth demultiplexer DMj may time-divisionally transfer, to the four sub-data lines Dja, Djb, Djc, and Djd of the jth data line, a data signal that is generated from the data driver 130 and then transmitted through the jth output line Oj. For example, the jth demultiplexer DMj may be one-to-four demultiplexer, for example. The demultiplexer DMj may take one single output line Oj as an input line and then switches the output line Oj to any one of the four sub-data lines Dja, Djb, Djc and Djd one at a time.

The sub-data lines Dja, Djb, Djc, and Djd may be extended along a first direction, and be connected to pixels PXL1, PXL2, PXL3, and PXL4 constituting one pixel column PRj. The pixels PXL1, PXL2, PXL3, and PXL4 may be sequentially arranged along the first direction. For the convenience of description, four pixels PXL1 PXL2, PXL3 and PXL4 are assumed to constitute one pixel column PRj. The present inventive concept is not limited thereto. For example, the four pixels PXL1, PXL2, PXL3 and PXL4 may be repeated along the first direction such that the one pixel column PRj may be formed of more than four pixels. For another example, more than four pixels may be repeated along the first direction to constitute one pixel column PRj.

The first sub-data line Dja may be connected to a first pixel PXL1 among the pixels PXL1 to PXL4 constituting the one pixel column PRj, and the second sub-data line Djb may be connected to a third pixel PXL3 among the pixels PXL1 to PXL4 constituting the one pixel column PRj. The third sub-data line Djc may be connected to a fourth pixel PXL4 among the pixels PXL1 to PXL4 constituting the one pixel column PRj, and the fourth sub-data line Djd may be connected to a second pixel PXL2 among the pixels PXL1 to PXL4 constituting the one pixel column PRj.

Pixels PXL1 to PXL4 constituting the jth pixel column PRj may include a first pixel PXL1, a second pixel PXL2, a third pixel PXL3, and a fourth pixel PXL4, which are alternately disposed.

The jth demultiplexer DMj may include first to fourth transistors Mj1 to Mj4 for transferring a data signal.

The first transistor Mj1 may be connected between the jth output line Oj and the first sub-data line Dja of the jth data line Dj, and an on/off operation of the first transistor Mj1 may be controlled by a first driving signal Cd1. The second transistor Mj2 may be connected between the jth output line Oj and the fourth sub-data line Djd of the jth data line Dj, and an on/off operation of the second transistor Mj2 may be controlled by a second driving signal Cd2. The third transistor Mj3 may be connected between the jth output line Oj and the second sub-data line Djb of the jth data line Dj, and an on/off operation of the third transistor Mj3 may be controlled by a third driving signal Cd3. The fourth transistor Mj4 may be connected between the jth output line Oj and the third sub-data line Djc, and an on/off operation of the fourth transistor Mj4 may be controlled by a fourth driving signal Cd4.

When the first driving signal Cd1 is supplied, the first transistor Mj1 may be turned on, and accordingly, the data signal of the jth output line Oj may be supplied to the first sub-data line Dja. In addition, when the second driving signal Cd2 is supplied, the second transistor Mj2 may be turned on, and accordingly, the data signal of the jth output line Oj may be supplied to the fourth sub-data line Djd. In addition, when the third driving signal Cd3 is supplied, the third transistor Mj3 may be turned on, and accordingly, the data signal of the jth output line Oj may be supplied to the second sub-data line Djb. In addition, when the fourth driving signal Cd4 is supplied, the fourth transistor Mj4 may be turned on, and accordingly, the data of the jth output line Oj may be supplied to the third sub-data line Djc.

The first to fourth transistors Mj1 to Mj4 may be turned on in different periods. To this end, turn-on periods of the respective first to fourth driving signals Cd1 to Cd4 may be non-overlapped with each other.

Figure 3:
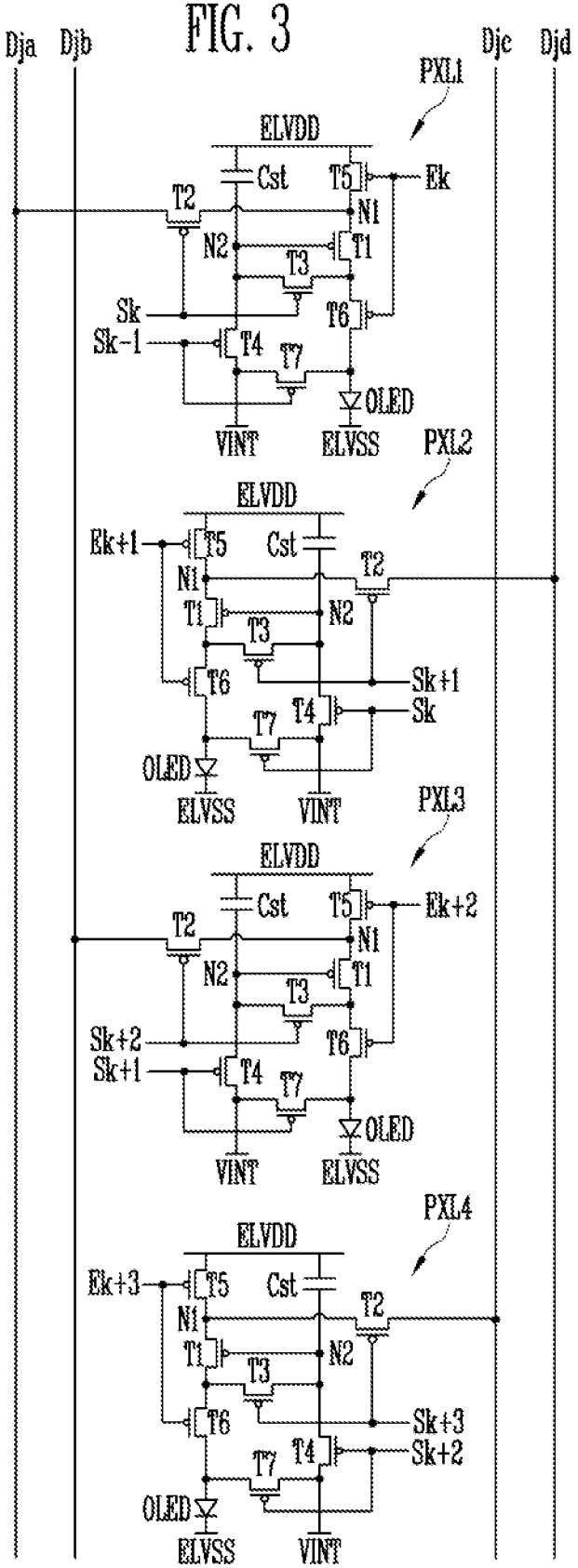
FIG. 3 is a diagram illustrating in more detail pixels shown in FIG. 2.

FIG. 3 is a diagram illustrating in more detail the pixels shown in FIG. 2. Referring to FIG. 3, the first pixel PXL1 may include a pixel circuit configured with a plurality of transistors T1 to T7 and a storage capacitor Cst, and an organic light emitting diode OLED.

An anode electrode of the organic light emitting diode OLED may be connected to the pixel circuit, and a cathode electrode of the organic light emitting diode OLED may be connected to a second power source ELVSS. The organic light emitting diode OLED may generate light with a predetermined luminance corresponding to an amount of current supplied from the pixel circuit. A first power source ELVDD supplied to the anode electrode may be set to a voltage higher than that of the second power source ELVSS such that the current can flow through the organic light emitting diode OLED.

The pixel circuit may control an amount of current flowing from the first power source ELVDD to the second power source ELVSS via the organic light emitting diode OLED. To this end, the pixel circuit may include a first transistor T1, a second transistor T2, a third transistor T3, a fourth transistor T4, a fifth transistor T5, a sixth transistor T6, a seventh transistor T7, and a storage capacitor Cst. The transistors T1 to T7 may be formed of PMOS transistors. The present inventive concept is not limited thereto. For example, the transistors T1 to T7 may be formed of NMOS transistors.

A first electrode of the first transistor (driving transistor) T1 may be connected to a first node N1, and a second electrode of the first transistor T1 may be connected to a first electrode of the sixth transistor T6. In addition, a gate electrode of the first transistor T1 may be connected to a second node N2. The first transistor T1 may control the amount of current flowing from the first power source ELVDD to the second power source ELVSS via the organic light emitting diode OLED, corresponding to a voltage stored in the storage capacitor Cst.

The second transistor T2 may be connected between a jth first sub-data line Dja and the first node N1. In addition, a gate electrode of the second transistor T2 may be connected to a kth scan line Sk. The second transistor T2 may be turned on when a scan signal is supplied to the kth scan line Sk, to electrically connect the jth first sub-data line Dja and the first node N1.

The third transistor T3 may be connected between the second electrode of the first transistor T1 and the second node N2. In addition, a gate electrode of the third transistor T3 may be connected to the kth scan line Sk. The third transistor T3 may be turned on when a scan signal is supplied to the kth scan line Sk, to connect the first transistor T1 in a diode form.

The fourth transistor T4 may be connected between the second node N2 and the initialization power source VINT. In addition, a gate electrode of the fourth transistor T4 may be connected to a (k−1)th scan line Sk−1. The fourth transistor T4 may be turned on when a scan signal is supplied to the (k−1)th scan line Sk−1 to supply the voltage of the initialization power source VINT to the second node N2.

The fifth transistor T5 may be connected between the first power source ELVDD and the first node N1. In addition, a gate electrode of the fifth transistor T5 may be connected to a kth emission line Ek. The fifth transistor T5 may be turned off when an emission control signal is supplied to the kth emission line Ek, and be turned on when the emission control signal is not supplied.

The sixth transistor T6 may be connected between the second electrode of the first transistor T1 and the anode electrode of the organic light emitting diode. In addition, a gate electrode of the sixth transistor T6 may be connected to the kth emission line Ek. The sixth transistor T6 may be turned off when an emission control signal is supplied to the kth emission line Ek, and be turned on when the emission control signal is not supplied.

The seventh transistor T7 may be connected between the anode electrode of the organic light emitting diode OLED and the initialization power source VINT. In addition, a gate electrode of the seventh transistor T7 may be connected to the (k−1)th scan line Sk−1. The seventh transistor T7 may be turned on when a scan signal is supplied to the (k−1)th scan line Sk−1, to supply the voltage of the initialization VINT to the anode electrode of the organic light emitting diode OLED.

In another embodiment, the gate electrode of the seventh transistor T7 may be connected to the kth scan line or a (k+1)th scan line Sk+1.

Meanwhile, the initialization power source VINT may be set to a voltage lower than a data signal. When the voltage of the initialization power source VINT is supplied to the anode electrode of the organic light emitting diode OLED, a parasitic capacitor of the organic light emitting diode OLED is discharged. When the parasitic capacitor of the organic light emitting diode OLED is discharged, the black expression ability of the first pixel PXL1 may be increased.

The storage capacitor Cst may be connected between the first power source ELVDD and the second node N2. The storage capacitor Cst may store a voltage corresponding to the data signal and a threshold voltage of the first transistor T1.

A first electrode of each of the transistors T1, T2, T3, T4, T5, T6, and T7 may be set as any one of a source electrode and a drain electrode, and a second electrode of each of the transistors T1, T2, T3, T4, T5, T6, and T7 may be set as an electrode different from the first electrode. For example, when the first electrode is set as the source electrode, the second electrode may be set as the drain electrode.

On the same pixel column PRj, the second pixel PXL2 may be located on a next row of the pixel row on which the first pixel PXL1 is located. The second pixel PXL2 may have a circuit configuration similar to that of the first pixel PXL1.

However, since the second pixel PXL2 is located on the next pixel row of the first pixel PXL1, the second pixel PXL2 may be connected to the kth scan line Sk, the (k+1)th scan line Sk+1, and a (k+1)th emission line Ek+1.

A gate electrode of a second transistor T2 and a gate electrode of a third transistor T3 may be connected to the (k+1)th scan line Sk+1, a gate electrode of a fourth transistor T4 and a gate electrode of a seventh transistor T7 may be connected to the kth scan line Sk, and a gate electrode of a fifth transistor T5 and a gate electrode of a sixth transistor T6 may be connected to the (k+1)th emission line Ek+1.

Also, the second pixel PXL2 may be connected to a jth fourth sub-data line Djd. The second transistor T2 of the second pixel PXL2 may be connected between the jth fourth sub-data Djd and a first node N1.

On the same pixel column PRj, the third pixel PXL3 may be disposed on a pixel row different from those of the first and second pixels PXL1 and PXL2. That is, the third pixel PXL3 may be located on a next row of the pixel row on which the second pixel PXL2 is located. The third pixel PXL3 may have a circuit configuration similar to those of the first pixel PXL1 and second pixel PXL2.

However, since the third pixel PXL3 is located on the next pixel row of the second pixel PXL2, the third pixel PXL3 may be connected to the (k+1)th scan line Sk+1, a (k+2)th scan line Sk+2, and a (k+2)th emission line Ek+2.

A second transistor T2 of the third pixel PXL3 may be connected between a jth second sub-data Djb and a first node N1.

On the same pixel column PRj, the fourth pixel PXL4 may be disposed on a pixel row different from those of the first to third pixels PXL1 to PXL3. That is, the fourth pixel PXL4 may be located on a next row of the pixel row on which the third pixel PXL3 is located. The fourth pixel PXL4 may have a circuit configuration similar to those of the first to third pixels PXL1 to PXL3.

However, since the fourth pixel PXL4 is located on the next pixel row of the third pixel PXL3, the fourth pixel PXL4 may be connected to the (k+2)th scan line Sk+2, a (k+3)th scan line Sk+3, and a (k+3)th emission line Ek+3.

A second transistor T2 of the fourth pixel PXL4 may be connected between a jth third sub-data line Djc and a first node N1.

Figure 4:
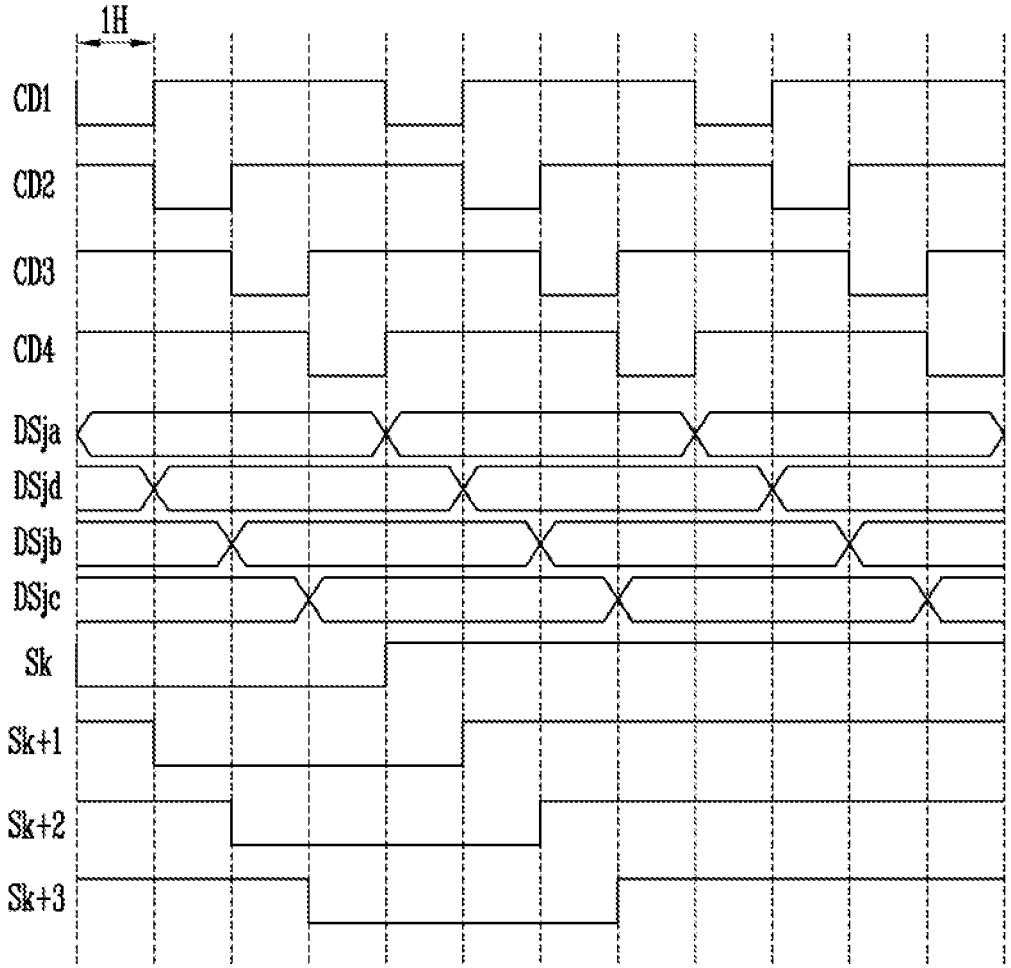
FIG. 4 is a waveform diagram illustrating output timings of signals output from a scan driver, a data driver, and a demultiplexer controller, which are shown in FIG. 1.

FIG. 4 is a waveform diagram illustrating output timings of signals output from the scan driver, the data driver, and the demultiplexer controller, which are shown in FIG. 1.

For convenience of description, only some scan signals and some data signals will be illustrated in FIG. 4. In FIG. 4, a timing may be uniformly divided in a unit of one horizontal period 1H, for example, with dashed vertical lines.

Referring to FIG. 4, a first control signal Cd1 may be repeatedly supplied in a period of four horizontal periods 4H. When a turn-on period of the first control signal Cd1 is supplied, a voltage of a data signal DSja may be charged in the first sub-data line Dja, and the data signal DSja may be supplied to first pixels PXL1. The voltage of the data signal DSja may be charged in the first sub-data line Dja during the four horizontal periods 4H. In addition, the threshold voltage compensation time of a first transistor T1 included in each of the first pixels PXL1 may be about four horizontal periods 4H.

After the first control signal Cd1 is supplied, a second control signal Cd2 may be supplied. The second control signal Cd2 may be repeatedly supplied using four horizontal periods 4H as a period. When the second control signal Cd2 is supplied, a voltage of a data signal DSjd may be charged in the fourth sub-data line Djd, and the data signal DSjd may be supplied to second pixels PXL2. The voltage of the data signal DSjd may be charged in the fourth sub-data line Djd during the four horizontal periods 4H. In addition, the threshold voltage compensation time of a first transistor T1 included in each of the second pixels PXL2 may be about four horizontal periods 4H. For the convenience of description, more detailed description will be made with reference to the second pixel PXL2 receiving a first scan signal through a first scan line Sk and a second scan signal through a second scan line Sk+1. During the first period during which a first voltage level (low level) of the first scan signal is applied to the first scan line Sk and a second voltage level (high level) of the second scan signal is applied to the second scan line Sk+1 an anode of the OLED and an electrode of the capacitor Cst may be initialized with the voltage of the initialization power source VINT. In this period, the second transistor T2 and the third transistor T3 are turned off that are supplied with the second voltage level of the second scan signal of the second scan line Sk+1. In the next period during which the second scan signal is turned to the first voltage level (low level), the second and third transistors T2 and T3 are turned on and thus data signal of the jth fourth sub-data line Djd is supplied to the first node N1 through the second transistor T2 and the second node N2 through the diode-connected transistor T1 during the four horizontal periods 4H. The four horizontal periods 4H may serve as a threshold voltage compensation time of the first transistor T1 in the second pixel PXL2. This description may be applicable to the other pixels PXL1 described above, and PXL3 and PXL4 that will be described below.

After the second control signal Cd2 is supplied, a third control signal Cd3 may be supplied. The third control signal Cd3 may be repeatedly supplied using four horizontal periods 4H as a period. When the third control signal Cd3 is supplied, a voltage of a data signal DSjb may be charged in the second sub-data line Djb, and the data signal DSjb may be supplied to third pixels PXL3. The voltage of the data signal DSjb may be charged in the second sub-data line Djb during the four horizontal periods 4H. In addition, the threshold voltage compensation time of a first transistor T1 included in each of the third pixels PXL3 may be about four horizontal periods 4H.

After the third control signal Cd3 is supplied, a fourth control signal Cd4 may be supplied. The fourth control signal Cd4 may be repeatedly supplied using four horizontal periods 4H as a period. When the fourth control signal Cd4 is supplied, a voltage of a data signal DSjc may be charged in the third sub-data line DSjc, and the data signal DSjc may be supplied to fourth pixels PXL4. The voltage of the data signal DSjc may be charged in the third sub-data line Djc during the four horizontal periods 4H. In addition, the threshold voltage compensation time of a first transistor T1 included in each of the fourth pixels PXL4 may be about four horizontal periods 4H.

The second control signal Cd2 may be a signal obtained by shifting the first control signal Cd1 by one horizontal period 1H. The first control signal Cd1 and the second control signal Cd2 may be supplied not to overlap with each other.

The third control signal Cd3 may be a signal obtained by shifting the second control signal Cd2 by one horizontal period 1H. The third control signal Cd3 may be supplied not to overlap with the first control signal Cd1 and the second control signal Cd2.

The fourth control signal Cd4 may be a signal obtained by shifting the third control signal Cd3 by one horizontal period 1H. The fourth control signal Cd4 may be supplied not to overlap with the first to third control signals Cd1 to Cd3.

Scan signals may be sequentially supplied while being shifted by one horizontal period 1H, and each of the scan signals may be supplied in a period of about four horizontal periods 4H. Scan signals supplied to two adjacent scan lines may overlap with each other by about three horizontal periods 3H.

Figure 5:
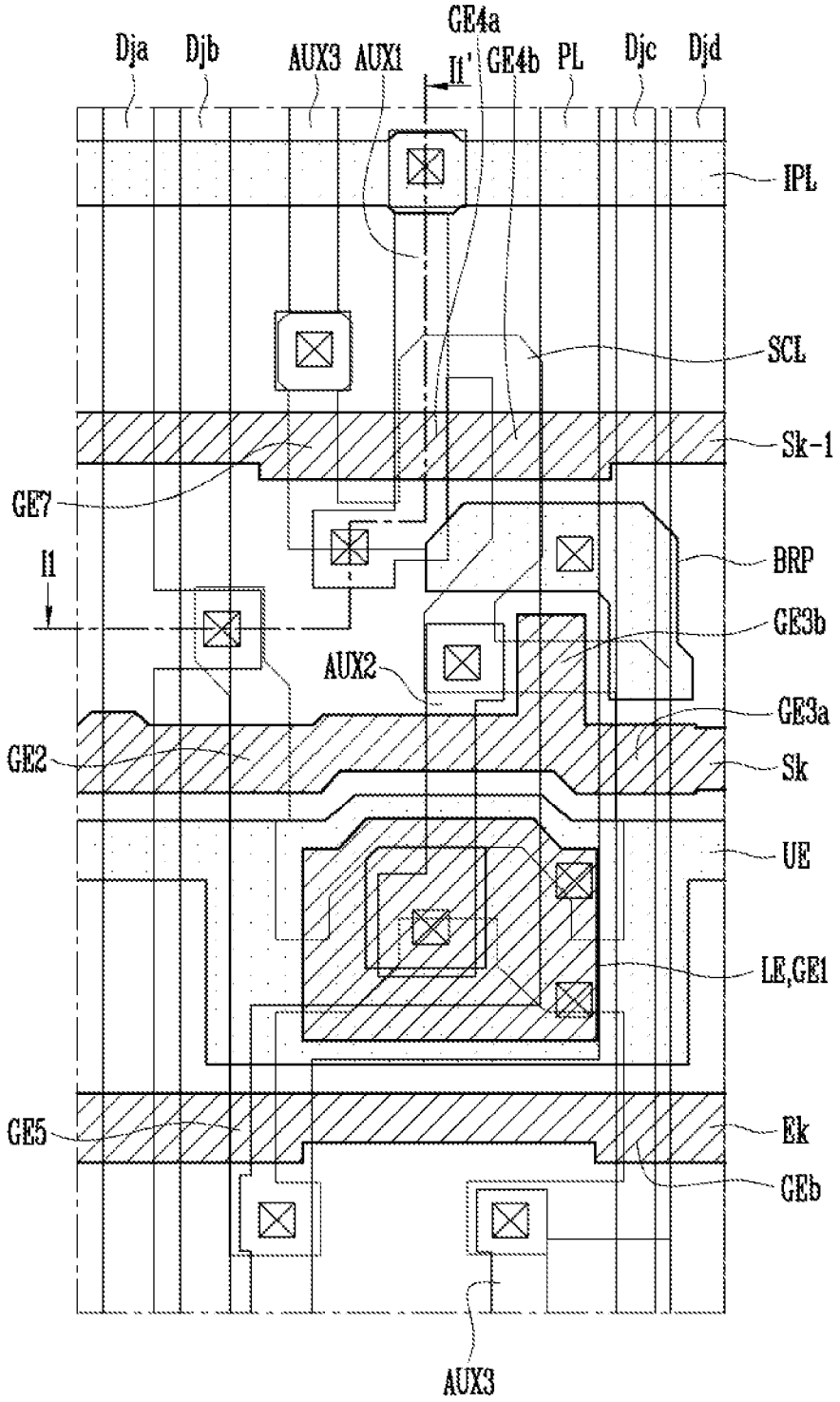
FIGS. 5 to 11 are diagrams illustrating a configuration of a pixel according to an embodiment of the present disclosure.
Figure 6:
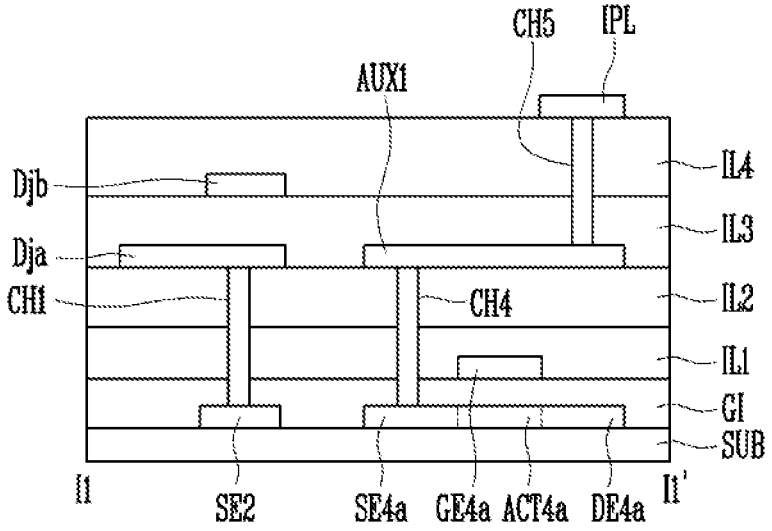
Figure 7:
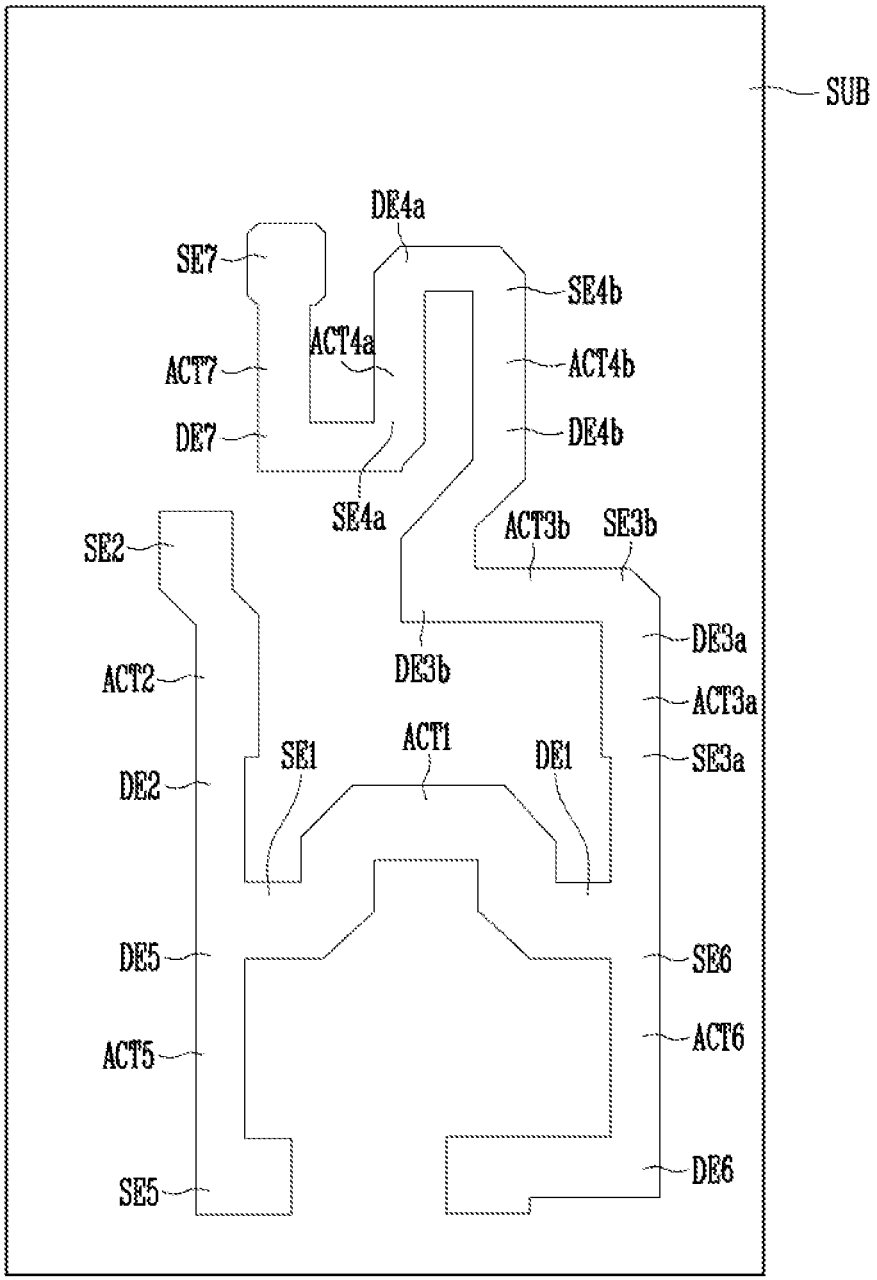
Figure 8:
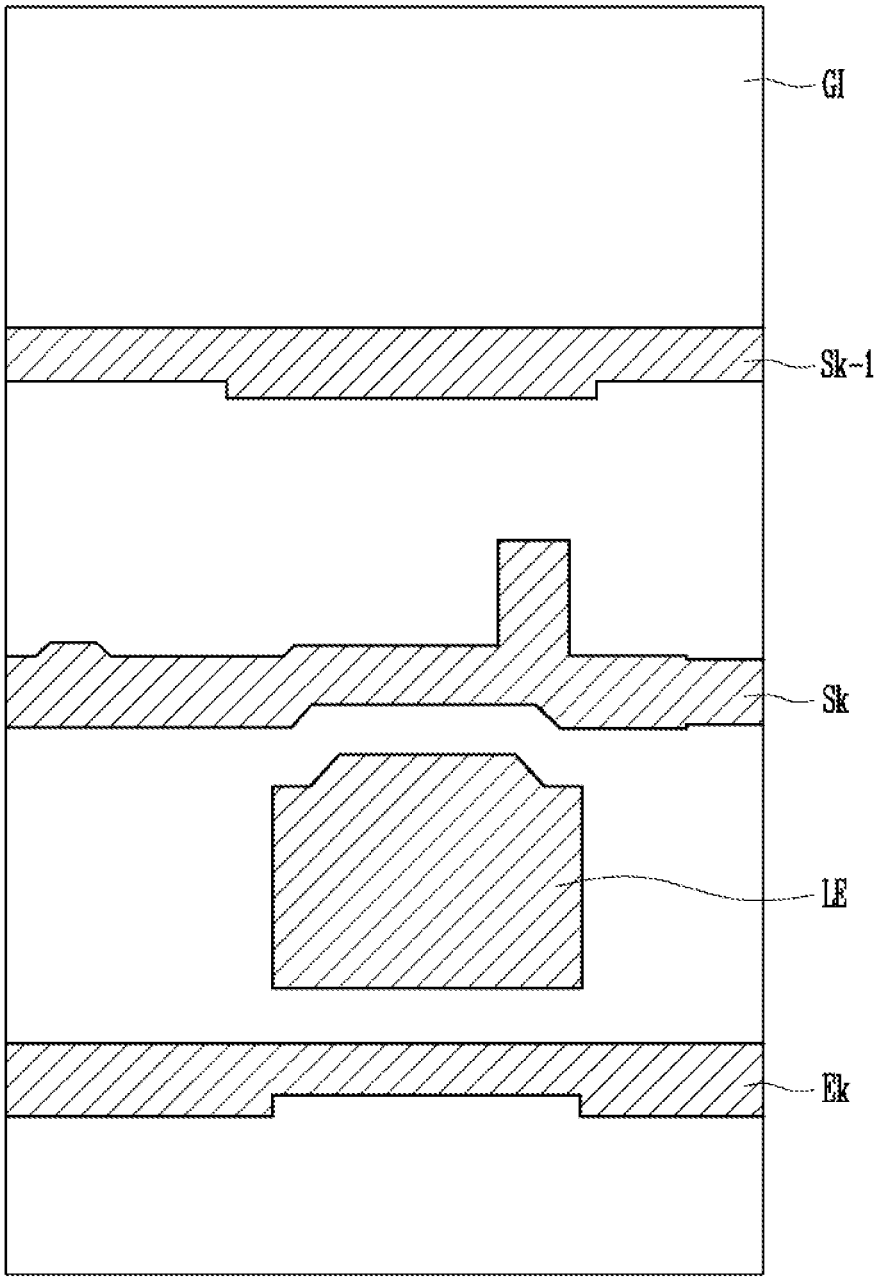
Figure 9:
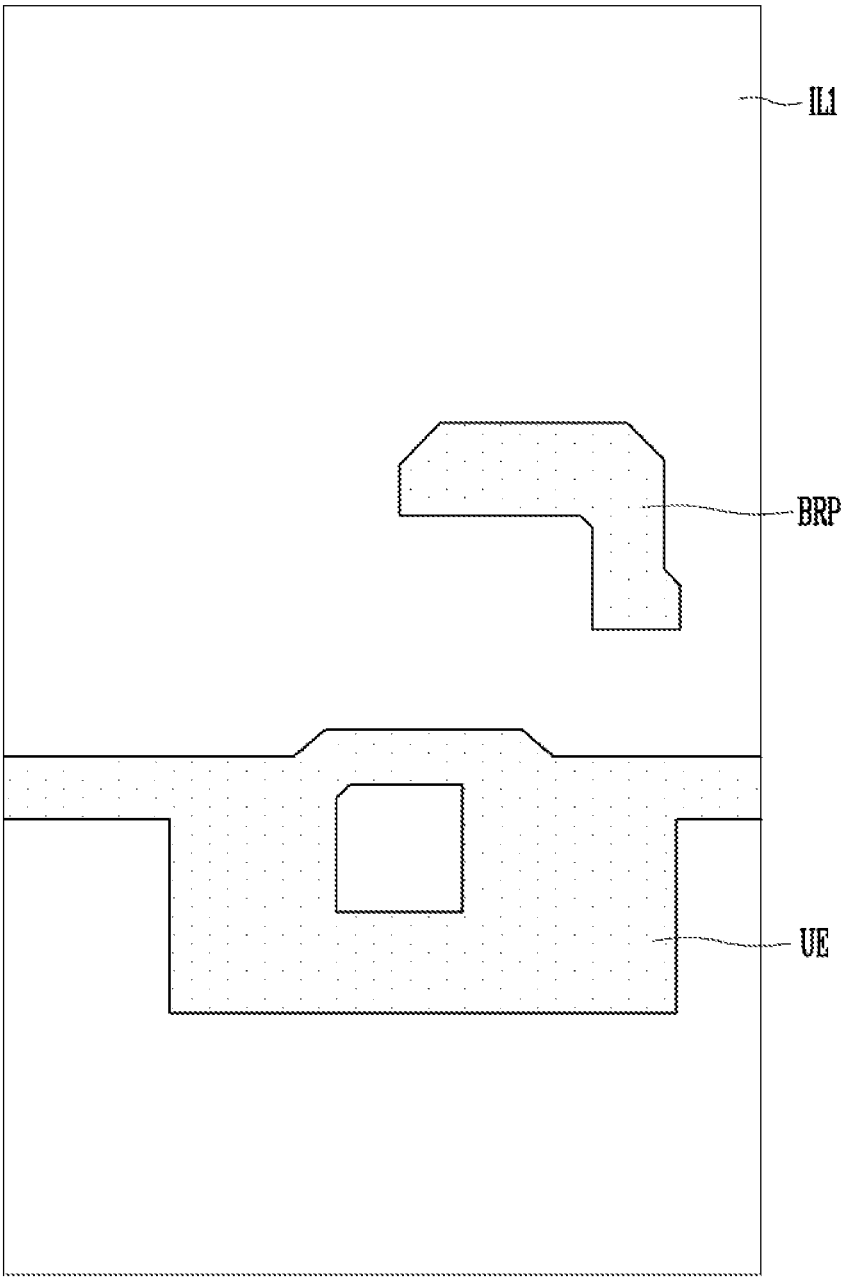
Figure 10:
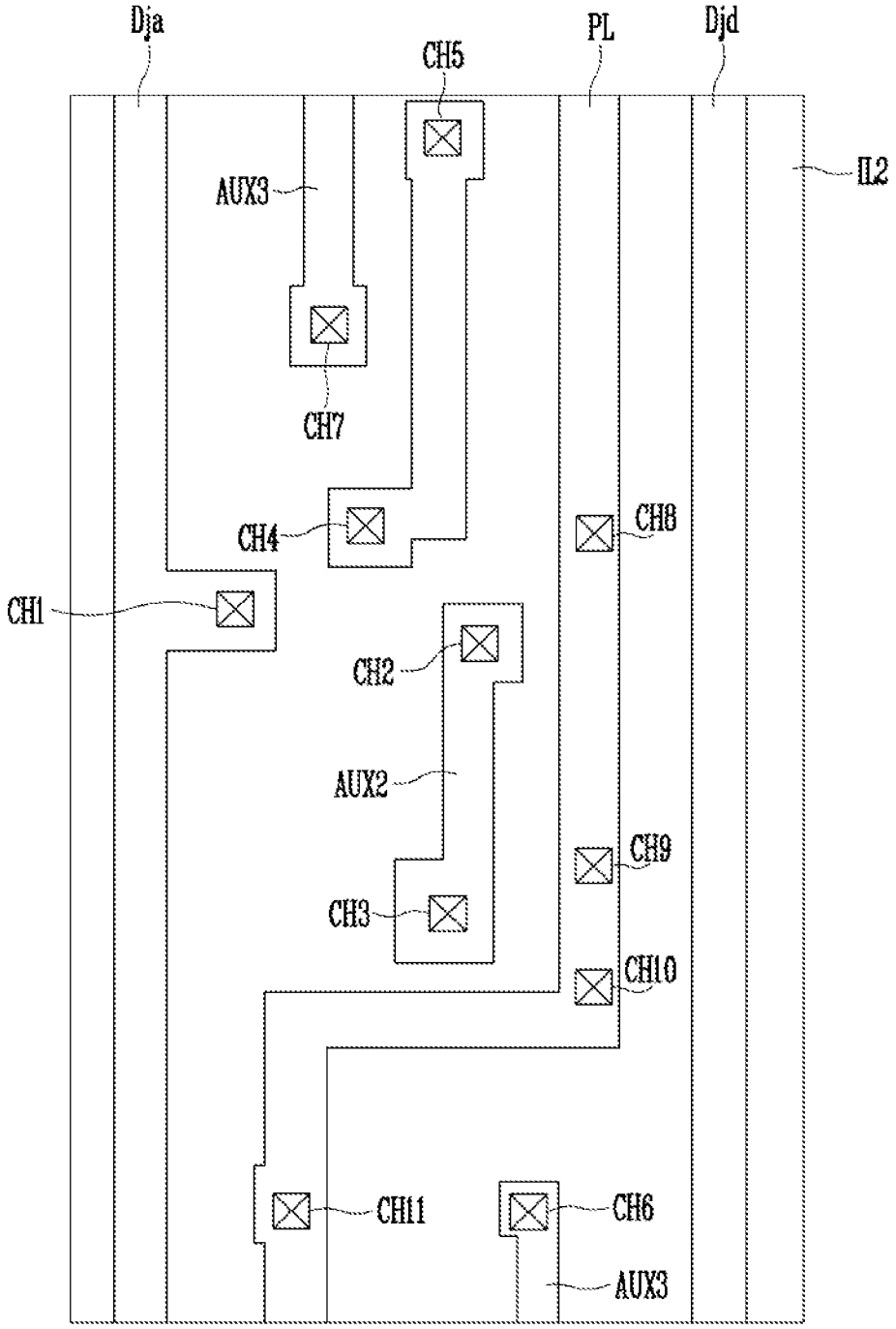
Figure 11:
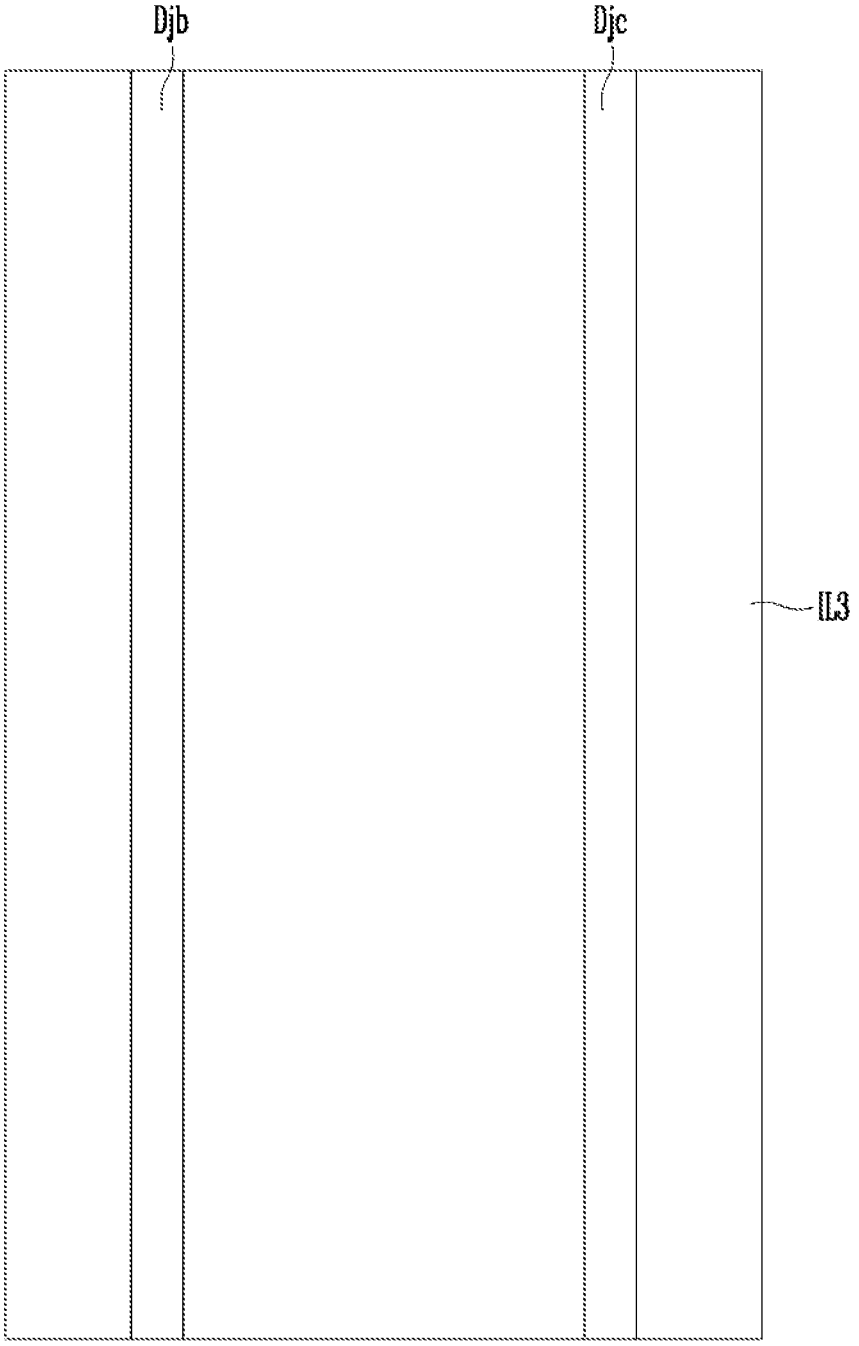

FIGS. 5 to 11 are diagrams illustrating a configuration of a pixel according to an embodiment of the present disclosure. In particular, FIG. 5 is a plan view illustrating a configuration of the first pixel shown in FIGS. 2 and 3, and FIG. 6 is a sectional view taken along line II-II' of FIG. 5. In addition, FIG. 7 is a plan view illustrating a semiconductor layer SCL shown in FIG. 5, FIG. 8 is a plan view illustrating scan lines Sk−1 and Sk, an emission control line Ek, and a lower electrode LE of a storage capacitor Cst, which are shown in FIG. 5, FIG. 9 is a plan view illustrating an upper electrode UE of the storage capacitor Cst shown in FIG. 5, and FIGS. 10 and 11 are plan views illustrating sub-data lines Dja, Djb, Djc, and Djd, a power line PL, and contact holes, which are shown in FIG. 5.

Referring to FIGS. 3 and 5 to 11, the pixel may be provided on a substrate SUB.

The substrate SUB may include a transparent insulating material through which light is transmitted. The substrate SUB may be a s rigid substrate. For example, the substrate SUB may be one of a glass substrate, a quartz substrate, a glass ceramic substrate, and a crystalline glass substrate.

Also, the substrate SUB may be a flexible substrate. The substrate SUB may be one of a film substrate and a plastic substrate, which include a polymer organic material. For example, the substrate SUB may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate. However, the material constituting the substrate SUB may be variously changed, and the substrate SUB may include a fiber reinforced plastic (FRP), etc.

Referring to FIGS. 3 and 5 to 11, a semiconductor layer SCL may be provided on the substrate SUB. The semiconductor layer SCL may include first to seventh active patterns ACT1 to ACT7, first to seventh source electrodes SE1 to SE7, and first to seventh drain electrodes DE1 to DE7. The first to seventh active patterns ACT1 to ACT7, the first to seventh source electrodes SE1 to SE7, and the first to seventh drain electrodes DE1 to DE7 may include a semiconductor material.

One end of the first active pattern ACT1 may be connected to the first source electrode SE1, and the other end of the first active pattern ACT1 may be connected to the first drain electrode DE1. The first active pattern ACT1, the first source electrode SE1, the first drain electrode DE1 and a first gate electrode GE1 may form the first transistor T1.

One end of the second active pattern ACT2 may be connected to the second source electrode SE2, and the other end of the second active pattern ACT2 may be connected to the second drain electrode DE2. The second active pattern ACT2, the second source electrode SE2, the second drain electrode DE2, and a second gate electrode GE2 may form the second transistor T2.

One end of a first third active pattern ACT3*a* may be connected to a first third source electrode SE3*a*, and the other end of the first third active pattern ACT3*a* may be connected to a first third drain electrode DE3*a*. One end of a second third active pattern ACT3*b* may be connected to a second third source electrode SE3*b*, and the other end of the second third active pattern ACT3*b* may be connected to a second third drain electrode DE3*b*. The third active patterns ACT3*a* and ACT3*b*, the third source electrodes SE3*a* and SE3*b*, third drain electrodes DE3*a* and DE3*b*, and third gate electrodes GE3*a* and GE3*b* may form the third transistor T3.

One end of a first fourth active pattern ACT4*a* may be connected to a first fourth source electrode SE4*a*, and the other end of the first fourth active pattern ACT4*a* may be connected to a first fourth drain electrode DE4*a*. One end of a second fourth active pattern ACT4*b* may be connected to a second fourth source electrode SE4*b*, and the other end of the second fourth active pattern ACT4*b* may be connected to a second fourth drain electrode DE4*b*, The fourth active patterns ACT4*a* and ACT4*b*, the fourth source electrodes SE4*a* and SE4*b*, the fourth drain electrodes DE4*a* and DE4*b*, and fourth gate electrode GE4*a* and GE4*b* may form the fourth transistor T4.

One end of the fifth active pattern ACT5 may be connected to a fifth source electrode SE5, and the other end of the fifth active pattern ACT5 may be connected to the fifth drain electrode DE5. The fifth active pattern ACT5, the fifth source electrode SE5, the fifth drain electrode DE5, and a fifth gate electrode GE5 may form a fifth transistor T5.

One end of the sixth active pattern ACT6 may be connected to the sixth source electrode SE6, and the other end of the sixth active pattern ACT6 may be connected to the sixth drain electrode DE6. The sixth active pattern ACT6, the sixth source electrode SE6, the sixth drain electrode DE6, and a sixth gate electrode GE6 may form the sixth transistor T6.

One end of the seventh active pattern ACT7 may be connected to the seventh source electrode SE7, and the other end of the seventh active pattern ACT7 may be connected to the seventh drain electrode DE7. The seventh active pattern ACT7, the seventh source electrode SE7, the seventh drain electrode DE7, and a seventh gate electrode GE7 may form the seventh transistor T7.

Meanwhile, although not shown in the drawings, a buffer layer may be provided between the substrate SUB and the semiconductor layer SCL.

The buffer layer may prevent an impurity from being diffused into the semiconductor layer SCL from the substrate SUB. The buffer layer may be provided in a single layer, but may be provided in a multi-layer including at least two layers. The buffer layer may include at least one of an organic insulating layer and an inorganic insulating layer. The organic insulating layer may include an organic insulating material that enables light to be transmitted therethrough. The inorganic insulating layer may include at least one of silicon oxide, silicon nitride, and silicon oxynitride. When the buffer layer is provided in the multi-layer, the layers may include the same material or include different materials.

Referring to FIGS. 5 to 8, a gate insulating layer GI may be provided on the semiconductor layer SCL. The gate insulating layer GI may include at least one of an organic insulating layer and an inorganic insulating layer. The organic insulating layer may include an organic insulating material that enables light to be transmitted therethrough. For example, the organic insulating layer may include at least one of photoresist, polyacrylates resin, epoxy resin, phenolic resin, polyamides resin, polyimides resin, unsaturated polyesters resin, poly-phenylene ethers resin, poly-phenylene sulfides resin, and benzocyclobutenes resin. The inorganic insulating layer may include at least one of silicon oxide, silicon nitride, and silicon oxynitride.

Referring to FIGS. 3 and 5 to 8, scan lines Sk−1 and Sk, an emission line Ek, and a lower electrode LE of a storage capacitor Cst may be provided on the gate insulating layer GI.

The scan lines Sk−1 and Sk, the emission line Ek, and the lower electrode LE of the storage capacitor Cst may include a metallic material. The metallic material may include at least one of gold (Au), silver (Ag), aluminum (Al), molybdenum (Mo), chromium (Cr) titanium (Ti), nickel (Ni), neodymium (Nd), copper (Cu), and alloys thereof. The scan lines Sk−1 and Sk, the emission line Ek, and the lower electrode LE of the storage capacitor Cst may be formed in a single layer, but the present disclosure is not limited thereto. For example, the scan lines Sk−1 and Sk, the emission line Ek, and the lower electrode LE of the storage capacitor Cst may be formed in a multi-layer in which two or more layers including at least one of gold (Au), silver (Ag), aluminum (Al), molybdenum (Mo), chromium (Cr), titanium (Ti), nickel (Ni), neodymium (Nd), copper (Cu), and alloys thereof are stacked.

The scan lines Sk−1 and Sk, the emission line Ek, and the lower electrode LE of the storage capacitor Cst may be formed of the same material through the same process.

A partial region of a kth scan line Sk may serve as the second gate electrode GE2 and the third gate electrode GE3, and a partial region of a (k−1)th scan line Sk−1 may serve as the fourth gate electrode GE4 and the seventh gate electrode GE7. A partial region of the emission line Ek may serve as the fifth gate electrode GE5 and the sixth gate electrode GE6. A partial region of the lower electrode LE of the storage capacitor Cst may serve as the first gate electrode GE1.

Referring to FIGS. 5 to 9, a first interlayer insulating layer IL1 may be provided over the scan lines Sk−1 and Sk, the emission line Ek, and the lower electrode LE of the storage capacitor Cst. The first interlayer insulating layer IL1 may include at least one of polysiloxane, silicon oxide, silicon nitride, and silicon oxynitride.

Referring to FIGS. 3 and 5 to 9, an upper electrode UE of the storage capacitor Cst may be provided on the first interlayer insulating layer IL1. The upper electrode UE of the storage capacitor Cst may be formed in a single layer or a multi-layer, which includes at least one of gold (Au), silver (Ag), aluminum (Al), molybdenum (Mo), chromium (Cr), titanium (Ti), nickel (Ni), neodymium (Nd), copper (Cu), and alloys thereof.

In addition, a bridge pattern BRP for blocking light incident into the third transistor T3 or the fourth transistor T4 may be further provided on the first interlayer insulating layer IL1.

Referring to FIGS. 6 to 10, a second interlayer insulating layer IL2 may be provided over the upper electrode UE of the storage capacitor Cst. The second interlayer insulating layer IL2 may include at least one of an inorganic insulating layer and an organic insulating layer. For example, the second interlayer insulating layer IL2 may include at least one inorganic insulating layer. The inorganic insulating layer may include at least one of silicon oxide, silicon nitride, and silicon oxynitride. Also, the second interlayer insulating layer IL2 may include at least one organic insulating layer. The organic insulating layer may include at least one of photoresist, polyacrylates resin, epoxy resin, phenolic resin, polyamides resin, polyimides resin, unsaturated polyesters resin, poly-phenylene ethers resin, poly-phenylene sulfides resin, and benzocyclobutenes resin. Also, the second interlayer insulating layer IL2 may have a multi-layered structure including at least one inorganic insulating layer and at least one organic insulating layer.

Referring to FIGS. 3 and 5 to 10, a first sub-data line Dja, a fourth sub-data line Djd, a power line PL, and auxiliary connection lines AUX1 to AUX3. The first sub-data line Dja, the fourth sub-data line Djd, the power line PL, and the auxiliary connection lines AUX1 to AUX3 may include a metallic material. Also, the first sub-data line Dja, the fourth sub-data line Djd, the power line PL, and the auxiliary connection lines AUX1 to AUX3 may be formed of the same material through the same process.

The power line PL may supply a first power source ELVDD, and be electrically connected to the source electrode SE5 of the fifth transistor T5 through an eleventh contact holes CH11 penetrating the gate insulating layer GI, the first interlayer insulating layer IL1, and the second interlayer insulating layer IL2. Also, the power line PL may be electrically connected to the upper electrode UE of the storage capacitor Cst through ninth and tenth contact holes CH9 and CH10 penetrating the second interlayer insulating layer IL2.

The first sub-data line Dja may supply a data signal, and be electrically connected to the source electrode SE2 of the second transistor T2 through a first contact hole CH1 penetrating the gate insulating layer GI, the first interlayer insulating layer IL1, and the second interlayer insulating layer IL2.

A first auxiliary connection line AUX1 may electrically connect the source electrode SE4*a* of the fourth transistor T4 and the drain electrode DE7 of the seventh transistor T7 to the initialization power line IPL. To this end, one end of the first auxiliary connection line AUX1 may be connected to the source electrode SE4*a* of the fourth transistor T4 and the drain electrode DE7 of the seventh transistor T7 through a fourth contact hole CH4. Also, the other end of the first auxiliary connection line AUX1 may be connected to the initialization power line IPL through a fifth contact hole CH5.

A second auxiliary connection line AUX2 may electrically connect to the drain electrode DE3*b* of the third transistor T3 and the gate electrode GE1 of the first transistor T1. To this end, one end of the second auxiliary connection line AUX2 may be connected to the drain electrode DE3*b* of the third transistor T3 through a second contact hole CH2, and the other end of the second auxiliary connection line AUX2 may be connected to the gate electrode GE1 of the first transistor T1 through a third contact hole CH3.

A third auxiliary connection line AUX3 may electrically connect the drain electrode DE6 of the sixth transistor T6 and the source electrode SE7 of the seventh transistor T7. To this end, one end of the third auxiliary connection line AUX3 may be connected to the drain electrode DE6 of the sixth transistor T6 through a sixth contact hole CH6, and the other end of the third auxiliary connection line AUX3 may be connected to the source electrode SE7 of the seventh transistor T7 through a seventh contact hole CH7.

Referring to FIGS. 5 to 11, a third interlayer insulating layer IL3 may be provided over the first sub-data line Dja, the fourth sub-data line Djd, the power line PL, and the auxiliary connection lines AUX1 to AUX3. The third interlayer insulating layer IL3 may include an organic insulating layer.

A second sub-data line Djb and a third sub-data line Djc may be provided on the third interlayer insulating layer IL3. The second sub-data line Djb and the third sub-data line Djc may be formed of the same material through the same process.

Meanwhile, in this specification, a case where the first and fourth sub-data lines Dja and Djd are located on the second interlayer insulating layer IL2, and the second and third sub-data lines Djb and Djc are located on the third interlayer insulating layer IL3 has been described, but the present disclosure is not limited thereto. For example, the second and third sub-data lines Djb and Djc may be located on the second interlayer insulating layer IL2, and the first and fourth sub-data lines Dja and Djd may be located on the third interlayer insulating layer IL3.

A fourth interlayer insulating layer IL4 may be provided over the second sub-data line Djb and the third sub-data line Djc. The fourth interlayer insulating layer IL4 may include an organic insulating layer.

The initialization power line IPL may be provided on the fourth interlayer insulating layer IL4. Although not shown in the drawings, an anode electrode of an organic light emitting diode OLED may be provided on the fourth interlayer insulating layer IL4.

The initialization power line IPL may be connected to an initialization power source VINT. The initialization power line IPL may be configured to transfer an initialization power of the initialization power source VINT. The initialization power line IPL may bypass the anode electrode of the organic light emitting diode OLED not to overlap with the anode electrode of the organic light emitting diode OLED.

Meanwhile, although not shown in the drawings, an encapsulation layer for encapsulating components of the display device, which are provided on the substrate SUB, may be further provided on the fourth interlayer insulating layer IL4.

In general, the threshold voltage compensation time of the first transistor T1, which is required to display an image having high-quality luminance, is a minimum of 3.6 (μs). Therefore, when one data line corresponds to one pixel column, the threshold voltage compensation time of the first transistor T1 is not sufficiently secured when a driving frequency increases.

However, in the display device 10 according to the embodiment of the present disclosure, a plurality of (particularly, four or more) data lines correspond to one pixel column, so that the time required to compensate for a threshold voltage of the first transistor may be sufficiently secured even when the driving frequency is 240 Hz or more.

Figure 12:
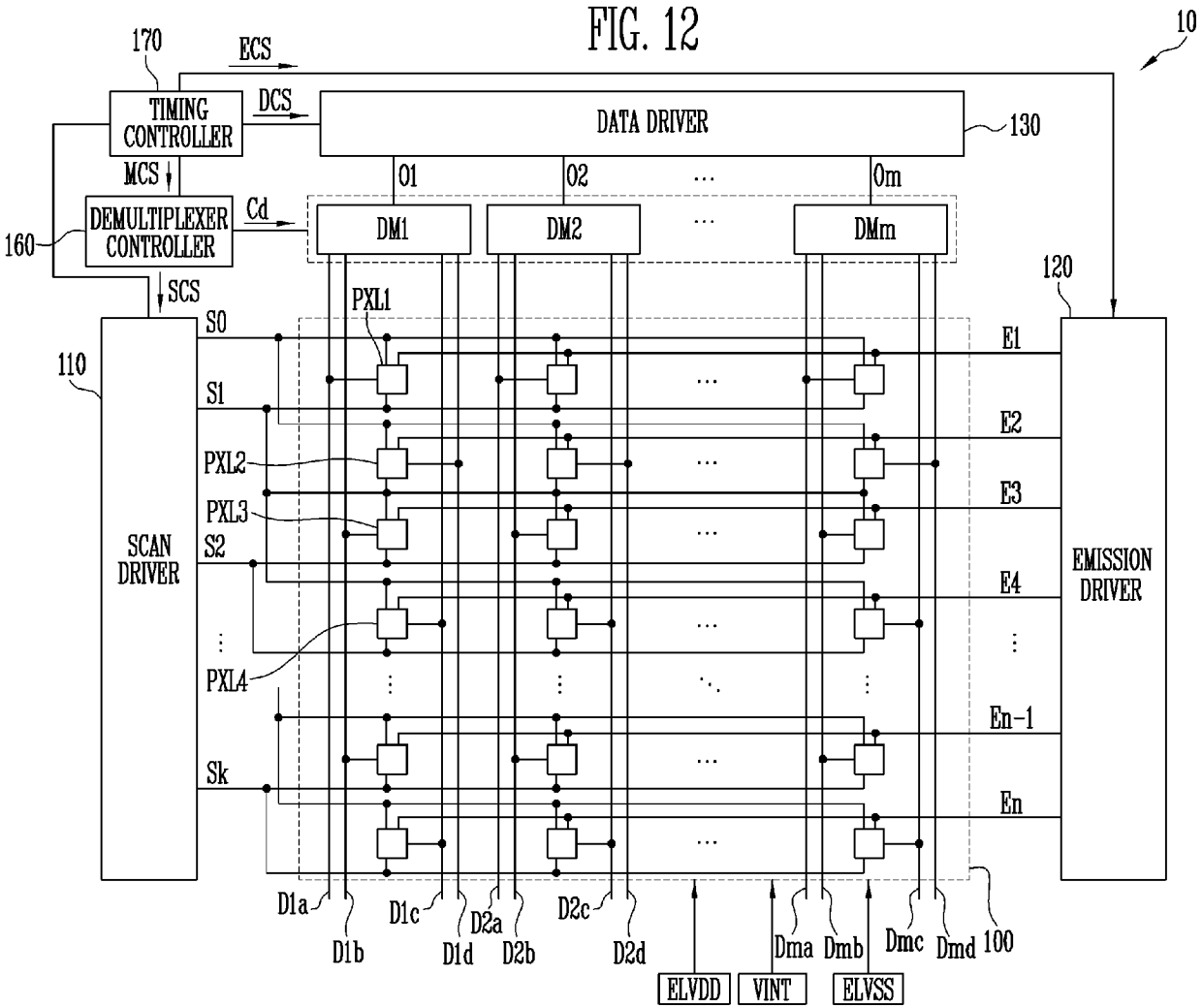
FIG. 12 is a diagram illustrating a configuration of a display device according to another embodiment of the present disclosure.

FIG. 12 is a diagram illustrating a configuration of a display device according to another embodiment of the present disclosure.

In FIG. 12, portions modified as compared with the above-described embodiment will be mainly described, and descriptions of portions overlapping with those of the above-described embodiment will be omitted. Hereinafter, a connection structure of a scan line and a pixel row will be mainly described.

Referring to FIG. 12, an ith scan line may be connected pixels PXL located on a kth pixel row and pixels PXL located on a (k+1)th pixel row, and a data signal may be supplied to the pixels PXL located on the kth pixel row and the pixels PXL located on the (k+1)th pixel row when a scan signal is supplied to the ith scan line.

For example, a first scan line S1 may be connected to first pixels PXL1 located on a first pixel row and second pixels PXL2 located on a second pixel row. When a scan signal is supplied to the first scan line S1, a data signal supplied to first sub-data lines D1*a*, D2*a*, and Dma may be supplied to the first pixels PXL1 located on the first pixel row, and a data signal supplied to fourth sub-data lines D1*d*, D2*d*, . . . , and Dmd may be supplied to the second pixels PXL2 located on the second pixel row.

In addition, a second scan line S2 may be connected to third pixels PXL3 located on a third pixel row and fourth pixels PXL4 located on a fourth pixel row. When a scan signal is supplied to the second scan line S2, a data signal supplied to second sub-data lines D1*b*, D2*b*, . . . , and Dmb may be supplied to the third pixels PXL3 located on the third pixel row, and a data signal supplied to third sub-data lines D1*c*, D2*c*, . . . , and Dmc may be supplied to the fourth pixels PXL4 located on the fourth pixel row.

Figure 13:
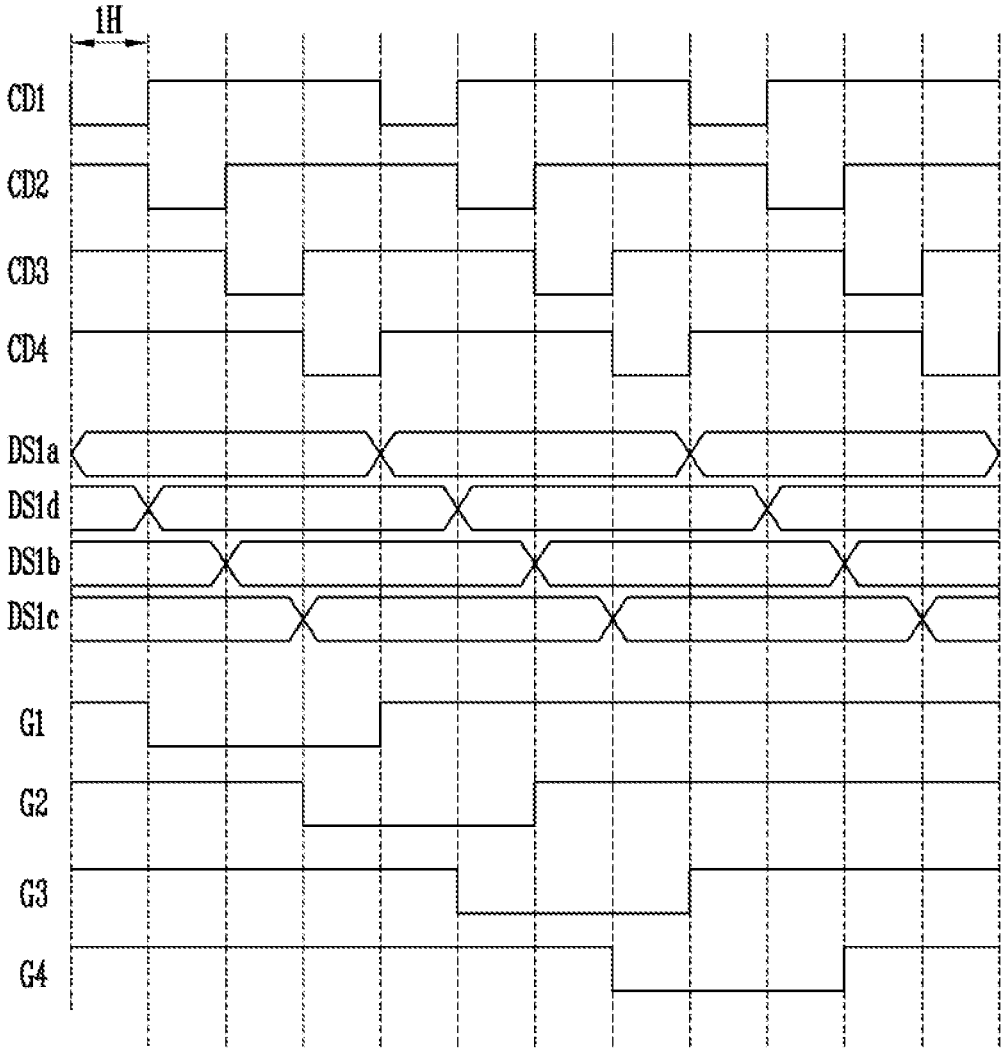
FIG. 13 is a waveform diagram illustrating output timings of signals output from a scan driver, a data driver, and a demultiplexer controller, which are shown in FIG. 12.

FIG. 13 is a waveform diagram illustrating output timings of signals output from the scan driver, the data driver, and the demultiplexer controller, which are shown in FIG. 12.

For convenience of description, only some scan signals G1 to G4 and some data signals DS1*a*, DS1*b*, DS1*c*, and DS1*d* are illustrated in FIG. 13.

Referring to FIG. 13, a first control signal Cd1 may be repeatedly supplied in a period of four horizontal periods 4H. When the first control signal Cd1 is supplied, a voltage of a data signal DS1*a* is charged in the first sub-data line D1*a*, and the data signal DS1*a* may be supplied to the first pixel PXL1. The voltage of the data signal DS1*a* may be charged in the first sub-data line D1*a* during the four horizontal periods 4H, and a threshold voltage of a first transistor included in the first pixel PXL1 may be compensated during three horizontal periods 3H in which a first scan signal GI is supplied.

After the first control signal Cd1 is supplied, a second control signal Cd2 may be supplied. The second control signal Cd2 may be repeatedly supplied in a period of four horizontal periods 4H. When the second control signal Cd2 is supplied, a voltage of a data signal DS1*d* may be charged in the fourth sub-data line D1*d*, and the data signal DS1 may be supplied to the second pixel PXL2. The voltage of the data signal DS1*d* may be charged in the fourth sub-data line did during the four horizontal periods 4H, and a threshold voltage of a first transistor included in the second pixel PXL2 may be compensated during the three horizontal periods 3H in which the first scan signal G1 is supplied.

After the second control signal Cd2 is supplied, a third control signal Cd3 may be supplied. The third control signal Cd3 may be repeatedly supplied in a period of four horizontal periods 4H. When the third control signal Cd3 is supplied, a voltage of a data signal DS1*b* may be charged in the second sub-data line D1*b*, and the data signal DS1*b* may be supplied to the third pixel PXL3. The voltage of the data signal DS1*b* may be charged in the second sub-data line D1*b* during the four horizontal periods 4H, and a threshold voltage of a first transistor included in the third pixel PXL3 may be compensated during three horizontal periods 3H in which a second scan signal G2 is supplied.

After the third control signal Cd3 is supplied, a fourth control signal Cd4 may be supplied. The fourth control signal Cd4 may be repeatedly supplied in a period of four horizontal periods 4H. When the fourth control signal Cd4 is supplied, a voltage of a data signal DS1*c* may be charged in the third sub-data line D1*c*, and the data signal DS1*c* may be supplied to the fourth pixel PXL4. The voltage of the data signal DS1*c* may be charged in the third sub-data line D1*c* during the four horizontal periods 4H, and a threshold voltage of a transistor included in the fourth pixel PXL4 may be compensated during the three horizontal periods 3H in which the second scan signal G2 is supplied.

Scan signals may be sequentially supplied while being shifted by two horizontal periods 2H, and each of the scan signals may be supplied during about three horizontal periods 3H. Scan signals supplied to two adjacent scan lines may overlap with each other by about one horizontal period 1H.

In the display device shown in FIGS. 12 and 13, the number of scan stages for generating a scan signal decreases, so that a dead space of the display device may be reduced.

According to the present disclosure, there can be provided a display device in which a threshold voltage compensation time of a driving transistor is sufficiently secured.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device, comprising:

a plurality of pixels;

a data driver configured to supply a plurality of data signals to a first output line thereof;

a data line including a first sub-data line, a second sub-data line, a third sub-data line, and a fourth sub-data line, wherein each of the first, second, third, and fourth sub-data lines is extended along a first direction and the first, second, third and fourth sub-data lines are arranged as listed in a second direction crossing the first direction; and a demultiplexer configured to connect the first output line of the data driver to one of the first, second, third and fourth sub-data lines one at a time so that each of the plurality of data signals is supplied to a corresponding pixel of the plurality of pixels, wherein the plurality of pixels include a first pixel, a second pixel, a third pixel, and a fourth pixel, which are sequentially arranged along a first column extending in the first direction, wherein the first sub-data line is connected to the first pixel, the second sub-data line is connected to the third pixel, the third sub-data line is connected to the fourth pixel, and the fourth sub-data line is connected to the second pixel, wherein the first sub-data line and the second sub-data line are provided at a first side of the first to fourth pixels arranged along the first column, and wherein the third sub-data line and the fourth sub-data line are provided at a second side of the first to fourth pixels arranged along the first column, the first side and the second side being opposite to each other.

2. The display device of claim 1, wherein the demultiplexer includes:

a first transistor connected to the first sub-data line, the first transistor being turned on by a first turn-on period of a first control signal;

a second transistor connected to the fourth sub-data line, the second transistor being turned on by a second turn-on period of a second control signal;

a third transistor connected to the second sub-data line, the third transistor being turned on by a third turn-on period of a third control signal; and a fourth transistor connected to the third sub-data line, the fourth transistor being turned on by a fourth turn-on period of a fourth control signal.

3. The display device of claim 2, wherein the first turn-on period of the first control signal, the second turn-on period of the second control signal, the third turn-on period of the third control signal, and the fourth turn-on period of the fourth control signal are non-overlapped with each other.

4. The display device of claim 1, wherein the first sub-data line and the second sub-data line are provided at a first side of the first to fourth pixels arranged along the first direction, and the third sub-data line and the fourth sub-data line are provided at a second side of the first to fourth pixels arranged along the first direction, the first side and the second side being opposite to each other.

5. The display device of claim 4, wherein each of the plurality of pixels includes:

a light emitting diode;

a first transistor configured to control an amount of current flowing through the light emitting diode; and a second transistor connected to the first transistor and one of the first to fourth sub-data lines.

6. The display device of claim 5, further comprising:

a gate insulating layer provided on a substrate;

a first interlayer insulating layer provided on the gate insulating layer;

a second interlayer insulating layer provided on the first interlayer insulating layer;

a third interlayer insulating layer provided on the second interlayer insulating layer; and a fourth interlayer insulating layer provided on the third interlayer insulating layer.

7. The display device of claim 6, comprising:

an active pattern provided on the substrate;

a first electrode and a second electrode provided on the substrate, wherein the first electrode is connected to one side of the active pattern and the second electrode is connected to another side of the active pattern; and a gate electrode provided on the gate insulating layer.

8. The display device of claim 6, wherein the first sub-data line and the fourth sub-data line are provided on the second interlayer insulating layer.

9. The display device of claim 8, wherein the second sub-data line and the third sub-data line are provided on the third interlayer insulating layer.

10. The display device of claim 8, wherein each of the plurality of pixels further includes:

a third transistor connected between a gate electrode of the first transistor and a second electrode of the first transistor;

a fourth transistor connected between the gate electrode of the first transistor and an initialization power source;

a fifth transistor connected between a first power source and a first electrode of the first transistor;

a sixth transistor connected between the second electrode of the first transistor and an anode electrode of the light emitting diode; and a seventh transistor connected between the initialization power source and the first electrode of the light emitting diode.

11. The display device of claim 10, further comprising:

an initialization power line configured to transfer an initialization power of the initialization power source to a node connected to the gate electrode of the first transistor through the fourth transistor, wherein the initialization power line is provided on the fourth interlayer insulating layer.

12. The display device of claim 10, further comprising:

a scan driver configured to supply a plurality of scan signals to the plurality of pixels through a plurality of scan lines; and an emission driver configured to supply a plurality of emission control signals to the plurality of pixels through a plurality of emission lines.

13. The display device of claim 12, wherein the plurality of scan lines include:

a first scan line connected to the second transistor included in the first pixel;

a second scan line connected to the second transistor included in the second pixel;

a third scan line connected to the second transistor included in the third pixel; and a fourth scan line connected to the second transistor included in the fourth pixel.

14. The display device of claim 12, wherein the plurality of scan lines include:

a first scan line connected to the second transistor included in the first pixel and the second transistor included in the second pixel; and a second scan line connected to the second transistor included in the third pixel and the second transistor included in the fourth pixel.

15. The display device of claim 12, wherein the plurality of scan lines and the plurality of emission lines are provided on the gate insulating layer.

16. A display device comprising:

a plurality of pixels sequentially arranged along a first direction;

a data driver having a plurality of output lines and generating a plurality of data signals;

a plurality of data lines, each including a plurality of sub-data lines extended along the first direction; and a plurality of demultiplexers, each connecting a corresponding output line of the plurality of output lines to a corresponding data line of the plurality of data lines and being configured to switch the corresponding output line to one of the plurality of sub-data lines one at a time so that each of the plurality of data signals is supplied to a corresponding pixel of the plurality of pixels, wherein the plurality of sub-data lines include a first sub-data line, a second sub-data line, a third sub-data line and a fourth sub-data line, wherein the plurality of pixels include a first pixel, a second pixel, a third pixel, and a fourth pixel sequentially arranged along in a first column extending in the first direction, wherein the first sub-data line is connected to the first pixel, the second sub-data line is connected to the third pixel, the third sub-data line is connected to the fourth pixel, and the fourth sub-data line is connected to the second pixel, wherein the first sub-data line and the second sub-data line are provided at a first side of the first to fourth pixels arranged along the first column, and wherein the third sub-data line and the fourth sub-data line are provided at a second side of the first to fourth pixels arranged along the first column, the first side and the second side being opposite to each other.

17. The display device of claim 16, wherein each of the plurality of demultiplexers is a one-to-four demultiplexer.

18. The display device of claim 16, further comprising:

a demultiplexer controller configured to generate a plurality of driving signals and output each of the plurality of driving signals to a corresponding demultiplexer of the plurality of demultiplexers.

19. The display device of claim 18, wherein each of the plurality of driving signals includes a turn-on period non-overlapped with turn-on periods of the others.

* * * * *